US012551751B2

(12) United States Patent
Shyr

(10) Patent No.: US 12,551,751 B2
(45) Date of Patent: Feb. 17, 2026

(54) PORTABLE REHABILITATION DEVICE AND METHODS OF USE

(71) Applicant: Song-Tse Shyr, Los Angeles, CA (US)

(72) Inventor: Song-Tse Shyr, Los Angeles, CA (US)

( * ) Notice: Subject to any disclaimer, the term of this patent is extended or adjusted under 35 U.S.C. 154(b) by 84 days.

(21) Appl. No.: 18/636,268

(22) Filed: Apr. 16, 2024

(65) Prior Publication Data

US 2024/0252882 A1 Aug. 1, 2024

Related U.S. Application Data

(63) Continuation-in-part of application No. PCT/US2022/031557, filed on May 31, 2022.

(60) Provisional application No. 63/300,267, filed on Jan. 18, 2022.

(51) Int. Cl.

| | |
|---|---|
| ***A63B 23/035*** | (2006.01) |
| ***A63B 21/00*** | (2006.01) |
| ***A63B 21/16*** | (2006.01) |
| ***A63B 22/00*** | (2006.01) |

(52) U.S. Cl.

CPC .... *A63B 23/03583* (2013.01); *A63B 21/1672* (2015.10); *A63B 21/4034* (2015.10); *A63B 21/4035* (2015.10); *A63B 2022/0094* (2013.01)

(58) Field of Classification Search

CPC ..... A63B 23/03583; A63B 21/1672; A63B 21/4034; A63B 21/4035; A63B 2022/0094; A63B 7/00; A63B 21/0055; A63B 23/03575; A63B 21/0087; A63B 21/4045; A63B 23/03541; A63B 71/0009; A63B 2208/0247; A63B 2210/50; A63B 21/4033; G16H 20/30

See application file for complete search history.

(56) References Cited

U.S. PATENT DOCUMENTS 4,290,599 A * 9/1981 Berger ..... A63B 21/00069 482/126
4,304,402 A * 12/1981 Ripp ..... A63B 21/055 482/125
4,373,716 A * 2/1983 Pagani ..... A63B 21/0004 482/130
4,591,150 A * 5/1986 Mosher ..... A63B 21/1663 482/125

(Continued)

*Primary Examiner* — Andrew S Lo
(74) *Attorney, Agent, or Firm* — Metropolis IP Group, LLC; Eric Kang

(57) ABSTRACT

The present invention is drawn to a novel multi-segment spine structure comprising a pair of resistance elements connected to the spine at one distal end and a second pair of resistance elements connected to the opposite distal end of the spine. At each distal end, each resistance element is mounted on a lateral support projecting orthogonally from the axis of the spine. As a result, this system anatomically resembles four extremities branching out at each corner of a human torso. Climbing-type exercises while in a supine position can be performed for conditioning a wide variety of major muscle groups. The system further comprises a single strap with two endpoints, where each endpoint is connectable to different portions of the spine assembly. The strap comprises a plurality of hand loops that the user can use, while the user's legs are pushing against the pedals and/or footwear to independently perform abdominal crunches.

20 Claims, 15 Drawing Sheets

(56) References Cited

U.S. PATENT DOCUMENTS 5,037,088 A * 8/1991 Bernstein ..... A63B 23/12 482/8
5,154,685 A * 10/1992 Chen ..... A63B 21/00043 482/121
5,397,288 A * 3/1995 Sayre ..... A63B 21/00069 482/125
5,529,559 A * 6/1996 Punzalan ..... A63B 21/4045 482/111
5,569,135 A * 10/1996 Chen ..... A63B 21/023 482/125
5,637,066 A * 6/1997 Chang ..... A63B 21/0004 482/121
D405,133 S * 2/1999 Morgan ..... D21/678
5,913,756 A * 6/1999 Glaser ..... A63B 21/05 482/125
5,954,622 A * 9/1999 Olschansky ..... A63B 21/4011 482/133
5,993,361 A * 11/1999 Paoli ..... A63B 21/4007 482/121
6,193,638 B1 * 2/2001 Barrett ..... A63B 21/0004 482/121
D470,201 S * 2/2003 Paull ..... D21/692
6,544,152 B2 * 4/2003 Rosati ..... A63B 23/03575 482/130
7,128,699 B2 * 10/2006 Hsu ..... A63B 21/0004 482/79
7,569,003 B1 * 8/2009 Huffman ..... A63B 21/4045 482/111
7,896,785 B1 * 3/2011 Marcus ..... A63B 21/4015 482/111
2007/0238588 A1 * 10/2007 Butler ..... A63B 21/4035 482/77
2007/0287617 A1 * 12/2007 Teng ..... A63B 21/4035 482/126
2008/0039300 A1 * 2/2008 Fisher ..... F04B 9/14 482/112
2008/0214369 A1 * 9/2008 Mancini ..... A63B 21/0552 482/121
2009/0105051 A1 * 4/2009 Sheets ..... A63B 21/00192 482/148
2013/0324376 A1 * 12/2013 Colby ..... A63B 21/4035 482/112
2014/0148316 A1 * 5/2014 Tsuchio ..... A63B 21/00065 482/112

* cited by examiner

PORTABLE REHABILITATION DEVICE AND METHODS OF USE

CROSS-REFERENCE TO RELATED APPLICATIONS

The present application claims priority to international application PCT/US2022/031557 filed on May 31, 2022, which, in turn, claims priority to provisional patent application No. 63/300,267 filed on Jan. 18, 2022, disclosures of which are incorporated herein at least by reference.

FIELD OF THE INVENTION

The field of the disclosure described herein relates to a system for exercise and physical rehabilitation and methods of use.

BACKGROUND OF THE INVENTION

Most exercise or therapeutic devices capable of full-body conditioning are bulky and often lack provisions for quick dismantling for transport or storage, such as the apparatus of Carruthers (US 2021/0394018 A1). Many systems also cater to a physically robust user community and are not intended for frail individuals like the elderly or those recovering from a physical injury. Therapy for the latter two types of users often requires close supervision or assistance from a trained physical and/or occupational therapist because of potential hazards like falling while walking.

Ideally, weak individuals should be conditioned on a bed in a supine position where the risk of injury is mitigated and therapists can even split attention with other patients if independent strengthening is possible. Current bed-situated exercises include the use of a large tube placed under the knees for gluteus maximus muscle bridging exercises as well as leg extensions for quadriceps strengthening. Another common bed exercise involves positioning the back of the user's ankle on a skate over a flatboard so the hip adductor and abductors are conditioned. Elastic resistance bands are popular for a variety of upper and lower extremity exercises. However, the issue with these systems is that there is no all-in-one device that strengthens the lower extremities, upper extremities, and the trunk that is also light enough in weight to be held independently by a frail user in a supine position while also being easy to use, compact, and collapsible for storage or transport.

SUMMARY OF THE INVENTION

The present invention is drawn to a novel multi-segment spine structure comprising a pair of resistance elements connected to the spine at one distal end and a second pair of resistance elements connected to the opposite distal end of the spine. At each distal end, each resistance element is mounted on a lateral support projecting orthogonally from the axis of the spine.

As a result, this system anatomically resembles four extremities branching out at each corner of a human torso. Climbing-type exercises while in a supine position can be performed for conditioning a wide variety of major muscle groups including but not limited to the gluteus maximus, hip flexors, quadriceps, calves, ankle flexors, triceps, biceps, and shoulders while helping to maintain a wide range of motion and to keep many joints loose.

The system further comprises a single strap with two endpoints, where each endpoint is connectable to different portions of the spine assembly. The strap comprises a plurality of hand loops that the user can use, while the user's legs are pushing against the pedals and/or footwear to independently perform abdominal crunches which strengthen the core of the body and promote trunk stability.

The preferred embodiment of the present system can easily weigh less than ten pounds and as little as three pounds while being collapsible for storage or transport. The present invention may also be anchored to a bed in several ways or suspended above a bed with a separate floor crane.

BRIEF DESCRIPTION OF THE DRAWINGS

The drawings are provided to facilitate understanding in the detailed description. It should be noted that the drawing figures may be in simplified form and might not be to precise scale. About the disclosure herein, for purposes of convenience and clarity, only directional terms such as top, bottom, left, right, up, down, over, above, below, beneath, rear, front, distal, and proximal are used for the accompanying drawings. Such directional terms should not be construed as limiting the scope of the embodiment in any manner.

DETAILED DESCRIPTION OF THE INVENTION

Figure 1:
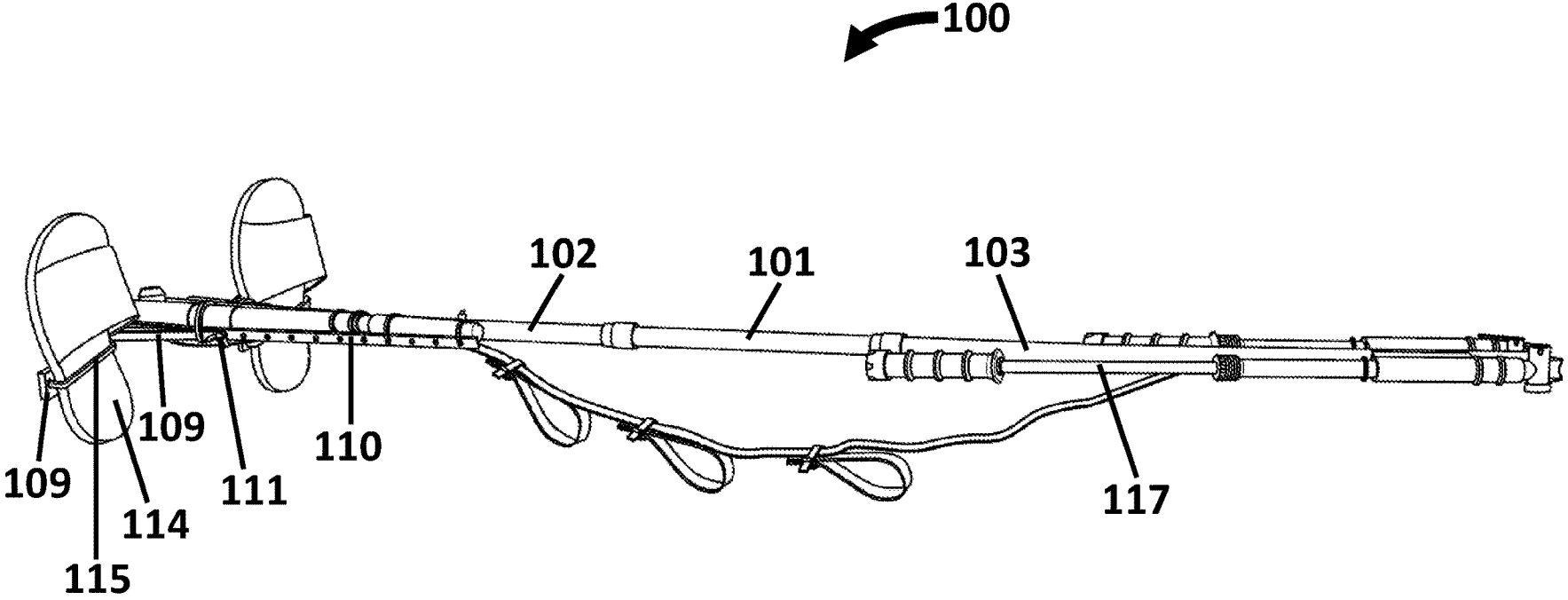
FIG. 1 is a substantially side perspective view of the exercise system.
Figure 2:
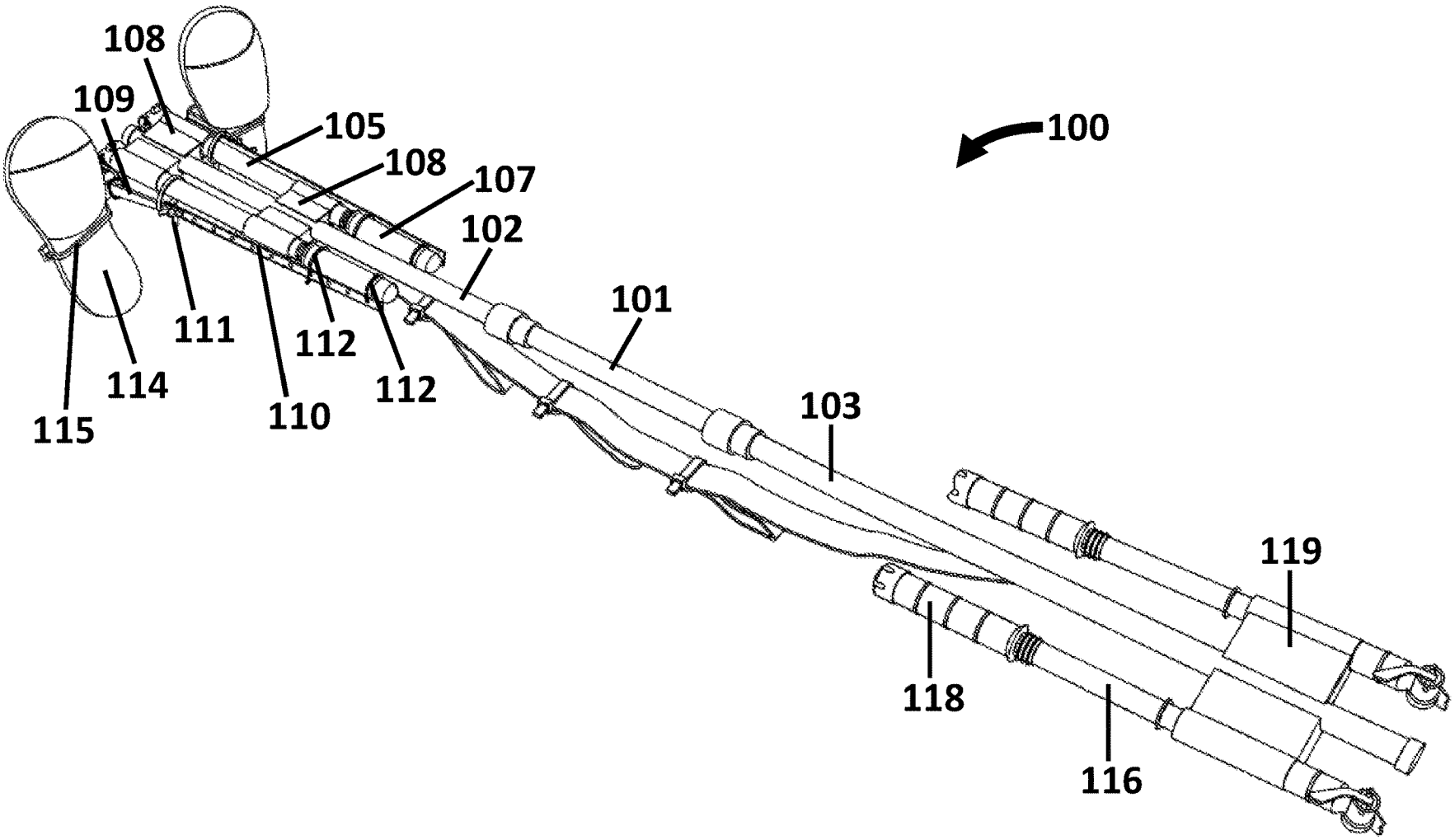
FIG. 2 is a substantially overhead perspective view of the exercise system.
Figure 3:
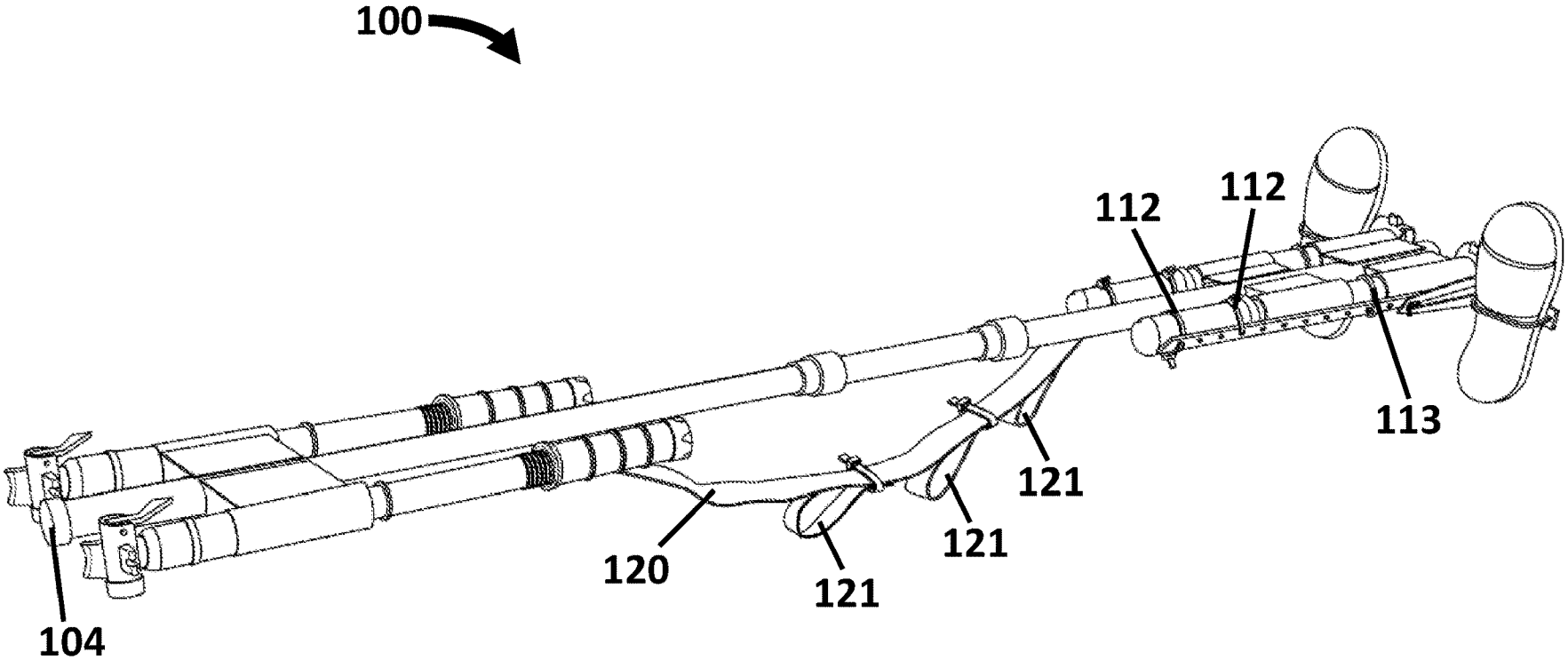
FIG. 3 is a trimetric perspective view of the exercise system.

FIGS. 1-4 show an exercise system 100 comprising of a central member or a tube-like spine with an upper endpoint and a lower endpoint at opposite ends of the spine. Preferred embodiments of the exercise system 100 comprise a middle segment 101, a lower extremity segment 102 that is removably attached to a first endpoint of the middle segment, and an upper extremity segment 103 that is removably attached to a second endpoint of the middle segment. The lower extremity segment 102 includes the lower endpoint while the upper extremity segment 103 includes the upper endpoint. At each of the lower and upper endpoints is a relatively soft rubber or synthetic equivalent pipe endcap 104, which prevents injury to another person/animal or damage to other items while providing a more finished appearance.

The middle segment 101 can come in an assortment of lengths so the exercise system 100 can be adapted for users of various heights and forms. Alternatively, the middle segment 101 and/or a portion of the lower extremity segment 102 and/or a portion of the upper extremity segment 103 may be telescoping.

Appropriate material and construction characteristics of the spine segments 101-103 include a high strength-to-weight ratio with cross-sectional dimensions that support minimal deflection during operation. The principal stress modes imposed on the spine segments 101-103 are axial (tension and compression) as well as bending; thus, the material of the spine segments 101-103 would preferably have isotropic properties. Suitable materials may include high void fraction lattice composites, carbon fiber, metal matrix composites, magnesium, bamboo, and for cost-conscious variants, more conventional plastics like polyvinyl chloride (PVC).

If PVC is used, preferred embodiments of the spine tubing 101-103 may use a PVC having an outer/inner diameter ranging from 0.840 inches/0.602 inches to 1.050 inches/0.804 inches, which equates to a weight per foot length of 0.170 pounds and 0.226 pounds, respectively. The exemplary embodiment of the spine segments 101-103 used an outer/inner diameter of 0.840 inches/0.602 inches. What is commonly viewed in the art as more "exotic" materials like lattice composites, carbon fiber, or metal matrix composites will support an even lighter frame. Weight savings for a given requisite structural rigidity may also be achieved by a combination of strategically located and shaped perforations and ribbing or local material build-up along portions of the spine tubing 101-103.

A pair of struts ("lower extremity struts") is mounted laterally offset from and parallel to the spine's lower extremity segment 102. Each lower extremity strut comprises a housing ("lower strut housing") 105 and a rod ("lower strut rod") 106. In the exemplary embodiment, the lower strut rod 106 is wrapped around by another tube ("lower strut rod tube") 107 of approximately the same outer diameter as the outer diameter of the lower strut housing 105 and has a high friction outer surface. This lower strut rod tube 107 does not need to be present, but an embodiment of a lower strut rod coupling provision to be discussed later makes this element desirable. With or without the lower strut rod tube 107, a distal end ("lower rod distal end") of the lower strut rod 106 should always be exposed outside the lower strut housing 105 even when the lower strut rod is fully retracted so that a lower strut rod coupling provision can be implemented.

Each lower strut rod 106 is capable of being axially extended ("extension") from and axially retracted ("retraction") into the lower strut housing 105 and therefore be capable of having a displacement velocity ("lower rod motion") when an external force is imparted on lower strut rod. The range of motion or stroke in the exemplary embodiment of the lower strut rod 106 is 12-24 inches.

The purpose of struts, as can be understood and appreciated by a person of ordinary skill in the art ("POSITA") is so that the lower rod motion is capable of generating resistive forces ("lower rod resistance") within said lower strut housing, where the lower rod resistance dampens lower rod motion during extension and/or lower rod resistance dampens lower rod motion during retraction.

The lower extremity strut may use air/gas and/or viscous liquid (collectively called "fluid") as the working medium, where a piston (not shown) attached to the lower strut rod 106 is moved during extension and retraction to displace the fluid along the length of the lower strut housing 105 and through an orifice, valve, stacked disks in cross-flow, or any other flow restriction (not shown) within the lower strut housing where resistive forces are developed. Strut embodiments that exclusively use air/gas struts will tend to be the lightest and such was used for the exemplary embodiment.

Certain embodiments of the exercise system 100 allow the lower rod resistance to be adjusted and the lower rod resistance can be different for extension and retraction. Adjustment may be accomplished by one or more knobs or levers attached to the lower strut housing 105 that are mechanically linked to the flow resistance elements within the lower strut housing. Alternatively, the lower strut housing 105 can be configured to contain magnetorheological fluid and induce any one of varying levels of electromagnet intensity to control the fluid's viscosity and thus, lower strut rod resistive forces.

Other embodiments may include wireless communications between an actuator and an electronic control device to mechanically adjust the level of flow restriction or the level of electric current induced onto the magnetorheological fluid. Aside from controlling lower strut rod resistive forces, embodiments of the exercise system 100 may additionally employ a reed sensor configured to detect the position of the lower strut rod 106 and register stroke repetitions of the lower strut rod in a battery-powered digital counter.

Each lower extremity strut 105-106 is connected to the lower extremity segment 102 by one or more lower strut supports 108. The lower strut support 108 may be a single piece or individual pieces branching laterally and perpendicular to the axis of the lower extremity segment 102. In the exemplary embodiment, there are a plurality of lower strut supports 108 grouped by one pair situated at the distal end of the lower extremity segment 102 and the distal end of the lower strut housing 105 furthest from the lower strut rod 106. A second pair of lower strut supports 108 is placed at the distal end of the lower strut housing 105 closest to the exposed portion of the lower strut rod 106 and along the lower extremity segment 102 in the same axial position as the distal end of the lower strut housing. The lower strut support 108 may be made of lattice composites, metal, metal matrix composite, or plastic.

The placement of the lower extremity struts 105-106 relative to the lower extremity spine 102 is symmetrical, and in the exemplary case, also along a single plane. There is no particular requirement for the lower extremity struts 105-106 and the lower extremity segment 102 to be in a planar arrangement; alternatively, the lower strut supports 108, and lower extremity struts 105-106 relative to the lower extremity spine 102 may form a V-profile as viewed from the lower endpoint. A V-profile pointed up or down may be preferred for users who are obese or who have unusually long or short femurs.

The exemplary geometry of each lower strut support 108 comprises "C" cutouts at opposite distal ends whose open sides face opposite directions. One cutout mates with the outer surface of the lower strut housing 105 and the other cutout mates with the outer surface of the lower extremity segment 102. There is a minimum distance between the opposite-facing cutouts that sets the clearance between the lower strut housing 105 and the lower extremity segment 102. An appropriate range for this minimum distance and clearance is nominally between 1.0-1.5 inches. This dimension in turn allows the pair of foot pedals 109, which will be discussed next, to be spaced apart at an anatomically correct distance.

The exemplary system may also offer an assortment of lower strut supports 108 with differing dimensions to adjust the clearance between the lower strut housing 105 and the lower extremity segment 102 as well as lateral spacing between left and right foot pedals 109. Alternative lower strut supports 108 with adjustment provisions comprising a spring-loaded pin and tube, tracks, ratchets, etc. may be used.

Each of the foot pedals 109 is part of a force transfer linkage 109-115, which transfers an external force from a user's foot to the lower strut rod 106. Each force transfer linkage comprises a foot pedal 109 that is attached to a pushrod 110 using a pedal-to-pushrod fastener 111. The exemplary foot pedal 109 has an L-shaped or elbow-like structure. Alternatively, each pushrod 110 may extend further so that each foot pedal 109 may be a straight post.

An exemplary foot pedal-to-pushrod fastener 111 may be a threaded shaft with a wingnut that can be tightened/loosened without the need for any tools. However suitable pedal-to-pushrod fasteners 111 may also include adhesive, clips, cotter pins, screws, threaded shaft/hex nut, or clamps.

The previously mentioned lower strut rod coupling provision 112 attaches each pushrod at one or more locations with the lower strut rod 106, or in the exemplary embodiment, the lower strut rod tube 107, so that the pushrod 110 is coupled to the distal end of the lower rod furthest from the lower endpoint of the lower extremity segment 102. In the exemplary embodiment, the lower strut rod coupling position 112 comprises one or more zip ties wrapping around the high friction outer surface of the lower strut rod tube 107 such that each is disposed through one of the array of holes within the pushrod 110. It is also acknowledged that a wide range of alternative lower strut rod coupling provision 112 is possible, including clips, screws disposed through threaded holes in the lower strut rod tube 107, clamps, or even having the lower strut rod tube 107 and the pushrod 110 molded as one piece.

To keep the pushrod 110 kinematics parallel to the axis of the lower extremity strut 105-106 during lower strut rod 106 displacements, one or more pushrod guides 113 are present. In the exemplary embodiment, the pushrod guide 113 is a ring that is attached to the pushrod 110 and slides relative to the lower strut housing 105. The clearance of the pushrod guide 113 and lower strut housing 105 is substantially less than 0.5 inch and preferably 0.125 to 0.25 inches. The pushrod guide 113 may be constructed from plastic but a lightweight metal, preferably high tensile strength steel, may be a suitable material.

Alternative embodiments may have the pushrod guide 113 attached to the lower strut housing 105. Another alternative embodiment of the pushrod guide 113 may be guide channels placed on the outer surface of the lower strut housing 105 that the pushrod 110 or a channel-riding element (not shown) attached to the pushrod can traverse through. Any of these pushrod guide 113 embodiments may further have one or more raised surfaces of the lower strut housing 105 or pushrod 110 or stops like blocks within the guide channels to set or limit the maximum range of lower strut rod 106 motion apart from the natural limitations of the lower strut rod displacement within the lower strut housing.

In the exemplary embodiment, the force transfer linkage 109-115 further comprises footwear 114 attached to the pedal 109 and wraps completely around a user's foot (including the bottom and top of the foot) along a portion of the foot's length so that the user 200 can flex his/her hip and pull up on the footwear to and extend the lower strut rod 106. The footwear 114 in the depicted embodiment is attached to the pedal 109 using a footwear-to-pedal connecting element 115, which in the exemplary embodiment is shown zip tie, but the footwear may be alternatively (not shown) riveted to the pedal, screwed into threaded holes within the pedal, slotted into channels attached to the pedal, clipped, or many other ways that are beyond the scope of the present disclosure. Preferred materials for the pedal 109, pushrod 110, and foot pedal-to-pushrod fastener 111 are a high strength-to-weight ratio metal, composite, or plastic.

A pair of upper extremity struts is mounted laterally offset from and parallel to the spine's upper extremity segment 103. As with the lower extremity struts 105-106, each upper extremity strut comprises a housing ("upper strut housing") 116 and a rod ("upper strut rod") 117.

Each upper strut rod 117 may be attached to a hand grip 118 with a high friction outer surface that wraps around portions of the upper strut rod 117 and has approximately the same outer diameter as the outer diameter of the upper strut housing 116. Alternatively, a hand loop (not shown) that is attached to the upper strut rod 117 may be used in place of the hand grip 118, but a hand loop would only be practical for extending the upper strut rod 117, and if the upper strut rod self-retracts. How the upper extremity strut 116-117 develops resistive forces and the numerous ways the resistive forces can be adjusted are identical to adjustment embodiments discussed earlier for the lower extremity strut 105-106.

Each upper extremity strut 116-117 is connected to the upper extremity segment 103 by one or more upper strut supports 119. The upper strut support 119 may be a single piece or individual pieces branching laterally and perpendicular to the axis of the upper extremity segment 103. In the exemplary embodiment, there is one pair of upper strut supports 119 situated along a portion of the upper extremity segment 103 and along the length of the upper strut housing 116. Alternative embodiments may have more than one pair of upper strut supports 119. The upper strut support 119 may be made of lattice composites, metal, metal matrix composite, or plastic.

The placement of the upper extremity struts 116-117 relative to the upper extremity spine 103 is symmetrical and, in the exemplary case, also along a single plane. There is no particular requirement for the upper extremity struts 116-117 and the upper extremity segment 103 to be in a planar arrangement; the upper strut supports 119 and upper extremity struts 116-117 relative to the upper extremity spine 103 may form a V-profile as viewed from the upper endpoint. A V-profile pointed up or down may be preferred for users who are obese or with unusually long or short arms.

The exemplary geometry of each upper strut support 119 comprises "C" cutouts at opposite distal ends whose open sides face opposite directions. One cutout mates with the outer surface of the upper strut housing 116 and the other cutout mates with the outer surface of the upper extremity segment 103. There is a minimum distance between the opposite-facing cutouts that sets the clearance between the upper strut housing 116 and the upper extremity segment 103. An appropriate range for this minimum distance and clearance is 2 to 3 inches. This dimension in turn allows the pair of hand grips 118 to be spaced apart at an ergonomically/anatomically correct distance. Its position also considers the balancing of forces not aligned to the axis of the strut/spine, exerted on either upper strut.

The exemplary system may also offer an assortment of upper strut support 119 with differing dimensions to adjust the clearance between the upper strut housing 116 and the upper extremity segment 103 as well as lateral spacing between left- and right-hand grips 118. Alternative upper strut supports 119 with adjustment provisions comprising a spring-loaded pin and tube, tracks, ratchets, etc. may be used.

In place of the lower and upper strut housings 105, 116; lower and upper strut rods 106, 117; lower strut rod tube 107, pushrod 110; pedal-to-pushrod fastener 111; and lower strut rod coupling provision 112; a plurality of rodless resistance elements may be used and are commonly known as rodless cylinders or actuators. Structurally, an embodiment of the rodless cylinders may also have a housing, but rodless cylinders differ from a conventional hydraulic or pneumatic strut in that no piston rod extends outside the strut housing body. Instead, the internal piston is connected to an external carriage.

Rodless cylinders require fewer parts and provide potential benefits in robustness, cost, lower weight, and obviate concerns about strut rod deflection and strut rod seal wear. Furthermore, the total length of the exercise system from one endpoint to the opposite endpoint of the spine may be shorter and thus, more compact, because one does not have to mount the upper and lower rodless cylinders as far apart from each other as upper and lower struts 105-106, 116-117 because one does not need to assure the strut rods 106, 117 can extend out the full stroke while also being at the proper location for the user 200 during use. Since both the upper and lower struts 105-106, 116-117, and alternative rodless cylinders provide kinematic resistance and damping, the struts discussed in the present disclosure and rodless cylinders may be generally called resistance elements.

The exercise system 100 further comprises a single strap 120 with two endpoints, where each endpoint is connectable to different portions of the spine 101-103 assembly. The strap comprises a plurality of hand loops 121 that the user 200 can use, while the user's legs are pushing against the pedals 109 and/or footwear 114 to independently perform abdominal crunches which strengthen the core of the body and promote trunk stability.

Figure 4:
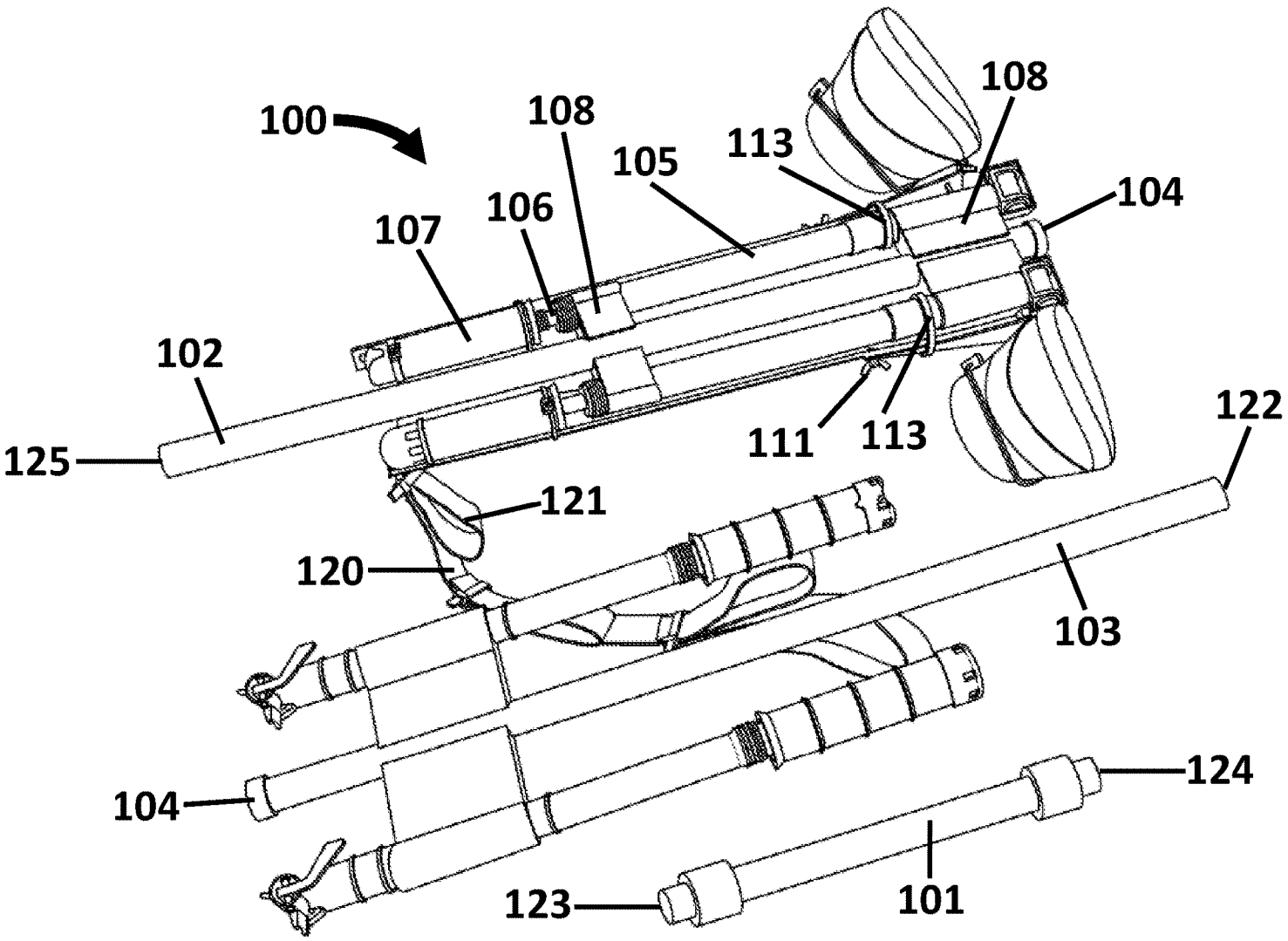
FIG. 4 is a view of the dismantled exercise system comprising the lower, middle, and upper segments.

FIG. 4 illustrates a disassembled view of an embodiment of the exercise system 100, where the middle segment 101 is detached from the lower extremity segment 102, and the middle segment is detached from the upper extremity segment 103. The spine 101-103 does not need to be collapsible and keeping the spine as one piece has its storage advantages, such as conveniently along a corner wall in an upright (spine substantially in a vertical) position. However, embodiments with a detachable spine 101-103 allow the components to be stored without a large footprint in any single dimension. This detachable aspect combined with the exemplary system's 100 minimal weight of around 3 pounds, without using "exotic" materials make for portability that is not replicated in any prior offerings that condition so many muscle groups.

Detachable spine embodiments 101-103 can be easily reassembled with the joint of the upper extremity segment 122 engageable to one of the joints of the middle segment 123, and the opposite joint of the middle segment 124 is engageable to the joint of the lower extremity segment 125. The coupling mechanisms (not shown) may include interference fit, band clamp surrounding overlapping joints from one segment with another or any variation on a locking mechanism such as a spring button and hole and threaded male and female topology near the joints. Where a segment overlaps with another, the inner diameter of one segment needs to be larger than the outer diameter of the mating segment at the joint location. For example, the middle segment 101 may have an inner diameter that is two to ten-thousandths of an inch larger than the outer diameter of the lower extremity segment 102 and upper extremity segment 103.

Figure 5B:
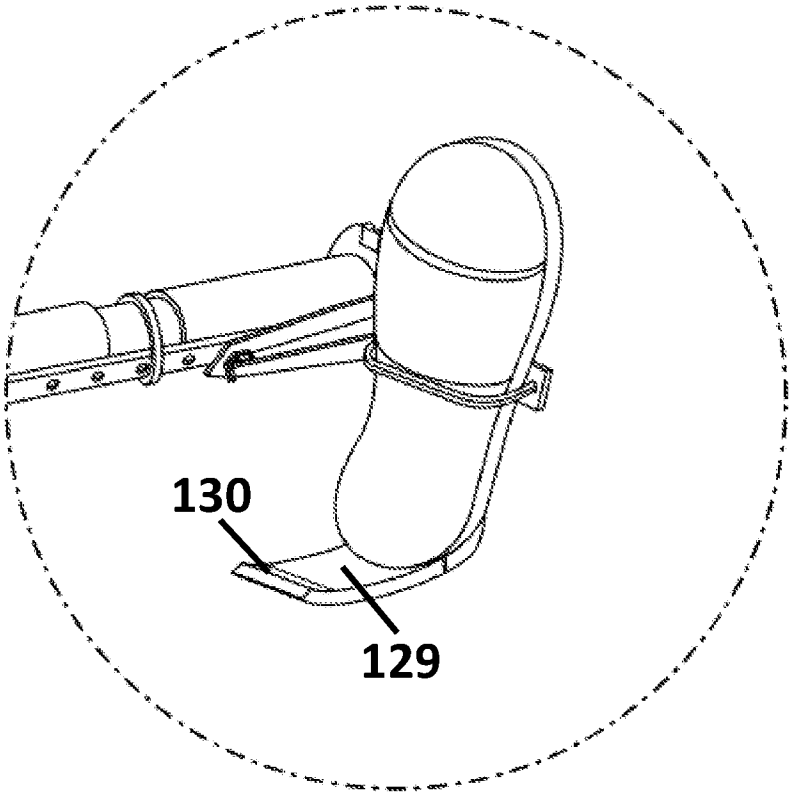
FIG. 5B is a view of an embodiment of the exercise system with the heel-stop subassembly in proximity to the right pedal.
Figure 5A:
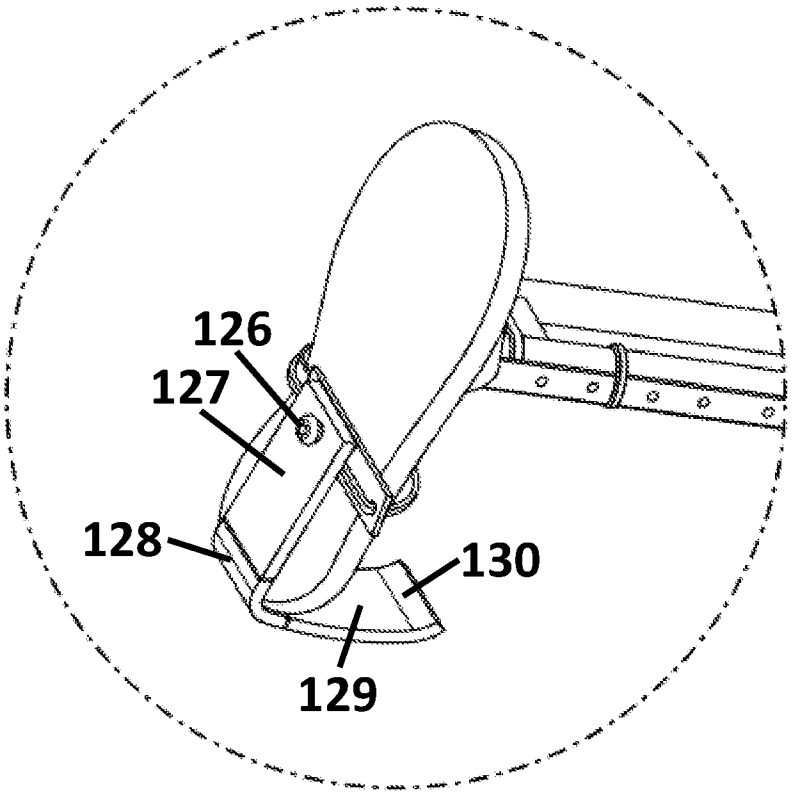
FIG. 5A is a view of an embodiment of the exercise system with a heel-stop subassembly in proximity to the left pedal.

FIGS. 5A and 5B depict an alternative embodiment of the exercise system 100 that further comprises a heel-stop subassembly 127-130 attached to each pedal 109 by a heel-stop fastener 126 with a shaft such as a rivet, pin, screw, or bolt. The heel-stop subassembly comprises a first segment 127, an elbow 128 with an approximately 90-degree angle between two adjoined portions, a heel-stop 129, and a heel retainer 130. The preferred embodiment of the heel-stop subassembly has its first segment 127, elbow 128, heel-stop 129, and heel retainer 130 be a single formed piece shaped like an "L" (i.e., L-shaped bracket) where the first segment is along the underside of the pedal 109 and underside of the footwear 114. One end of the first segment 127 near the end of the footwear 109 where the user's heel would normally be placed is connected to a first end of the elbow 128. The second end of the elbow 128 is connected to a first end of the heel-stop 129. A second end of the heel-stop 129 is connected to a heel retainer 130 that is preferably shaped like an upwardly curved lip. The heel-stop 129 is normally where a portion of the heel of one of the user's feet would rest and the heel retainer 130 would help keep the foot in place on the footwear 114.

Preferably, the heel-stop subassembly 127-130 is formed (i.e., molded or cast) from a single piece of plastic, composite, or metal. The side of the heel-stop 129 and heel retainer 130 in contact with the user's foot may be padded for comfort and/or have a higher friction surface made of non-slip materials like DYCEM® or rubber.

Figure 6B:
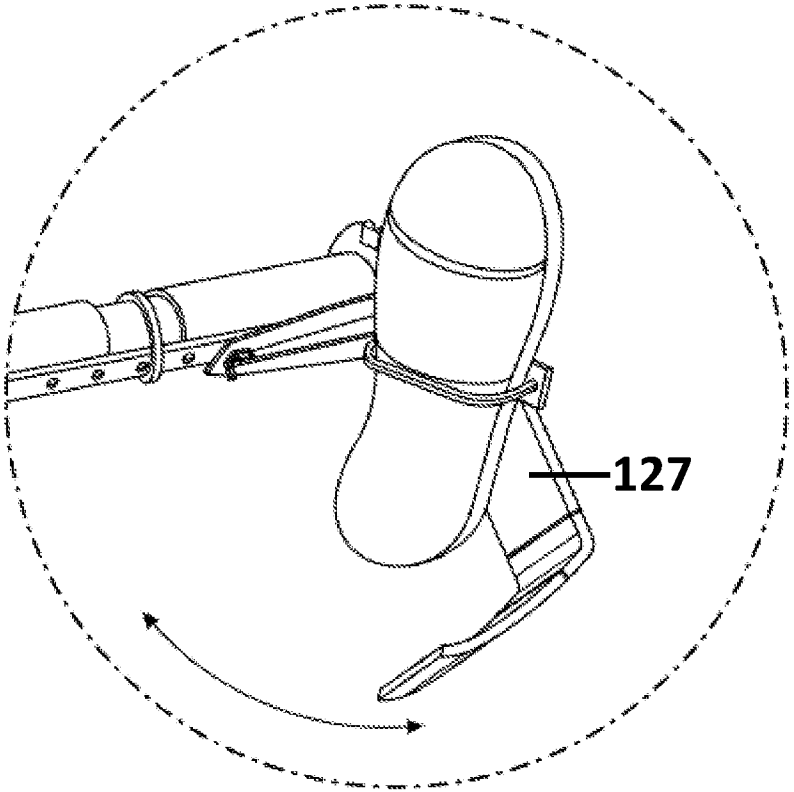
FIG. 6B shows a variation of FIG. 5B where the heel-stop subassembly is swung over at an angle and is capable of freely swinging about its pinned axis.
Figure 6A:
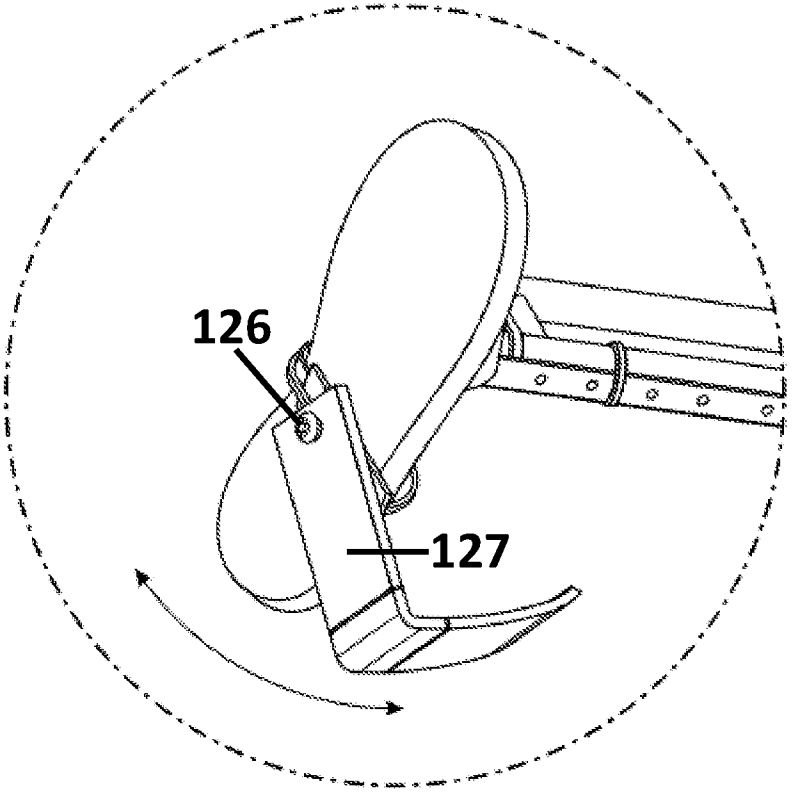
FIG. 6A shows a variation of FIG. 5A where the heel-stop subassembly is swung over at an angle and is capable of freely swinging about its pinned axis.

The heel-stop fastener 126 is disposed through a portion of the heel-stop subassembly's first segment 127 and a fastener hole in the pedal 109 in a "loose" manner that allows its first segment, elbow 128, heel-stop 129, and heel retainer 130 to freely rotate about the axis of the fastener, as shown in FIGS. 6A and 6B. This rotation feature for the heel-stop subassembly 127-130 allows quick and easy ingress and egress of the user's foot onto the footwear 114. This is possible by having the shaft portion of the heel-stop fastener 126 outside the fastener hole of the fixed pedal 109 which is longer than the thickness of the first segment 127.

Figure 7:
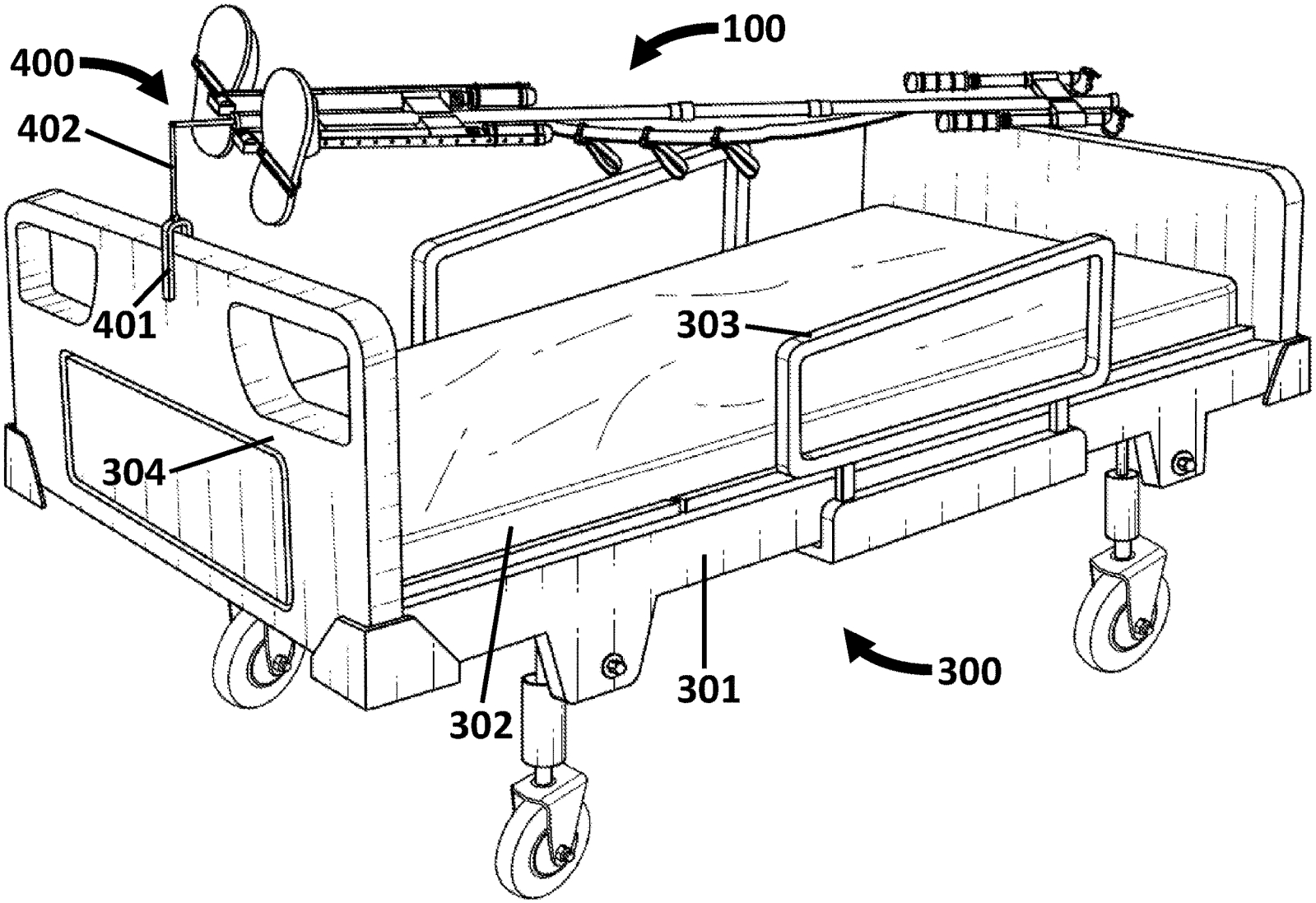
FIG. 7 is a perspective view of the exercise system mounted to a hospital bed frame using a plurality of rigid bars and links.

The exercise system 100 may also be anchored to or suspended above a bed to rehabilitate patients in a hospital who are too weak and/or injured to receive therapy outside of bed. FIG. 7 shows how the exercise system 100 can be easily situated above an exemplary hospital bed 300 with a bed frame 301, a mattress 302, side rails 303, and a footboard 304. The depicted embodiment shows a clamping element 401 clamped onto the footboard 304. A connector 402 is attached on one end to the clamping element 401 and at the other end, the endpoint of the lower extremity segment 102 without the end cap 104. Preferred embodiments of the connector 402 include a pinned or ball joint (not shown) to allow the system 100 to pitch or swivel, respectively, so the user may more easily align with the system during use.

Figure 8:
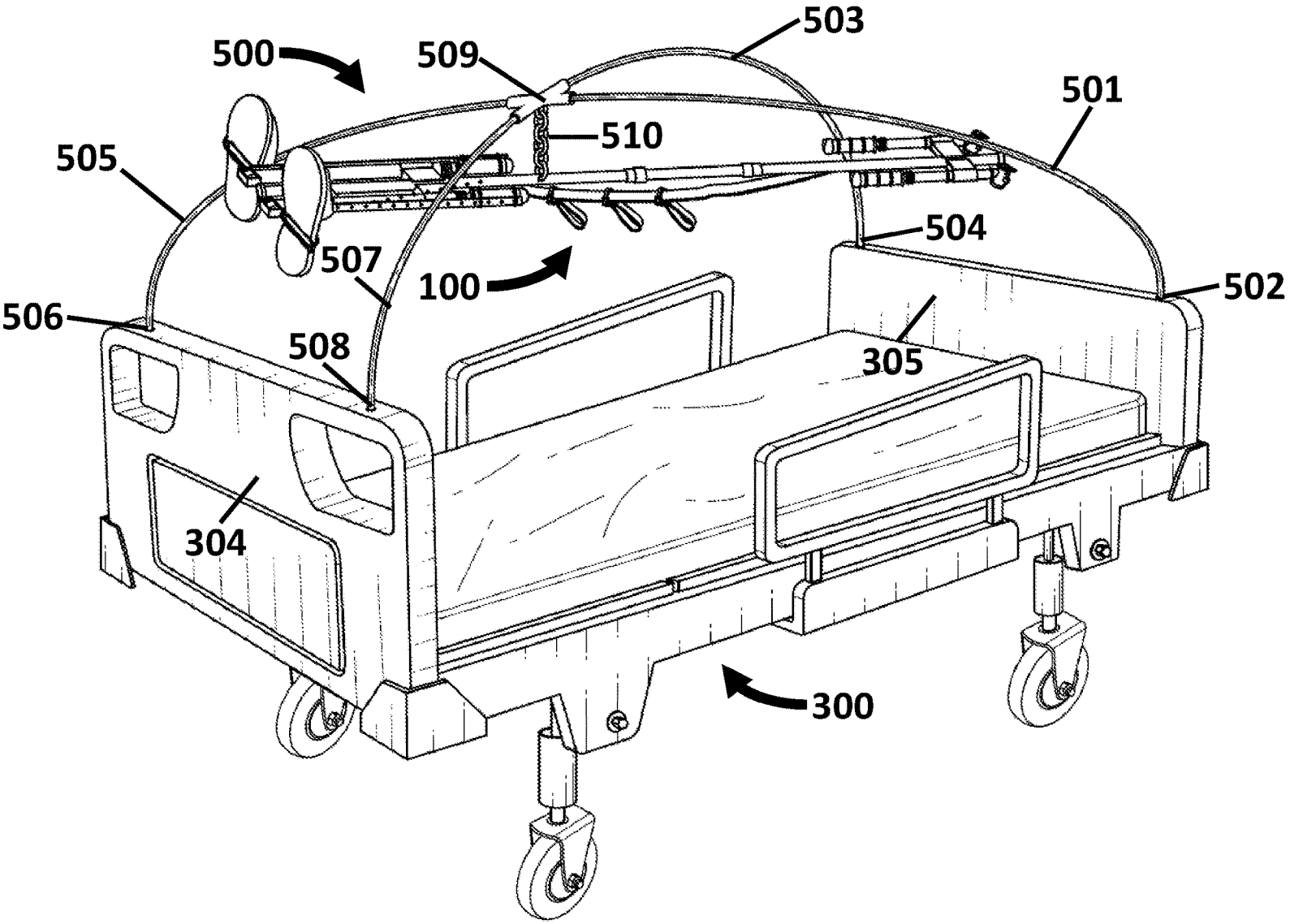
FIG. 8 is a perspective view of the exercise system suspended by a tube connector that in turn is supported by a plurality of flexible rods fixed to the hospital bed frame.
Figure 9:
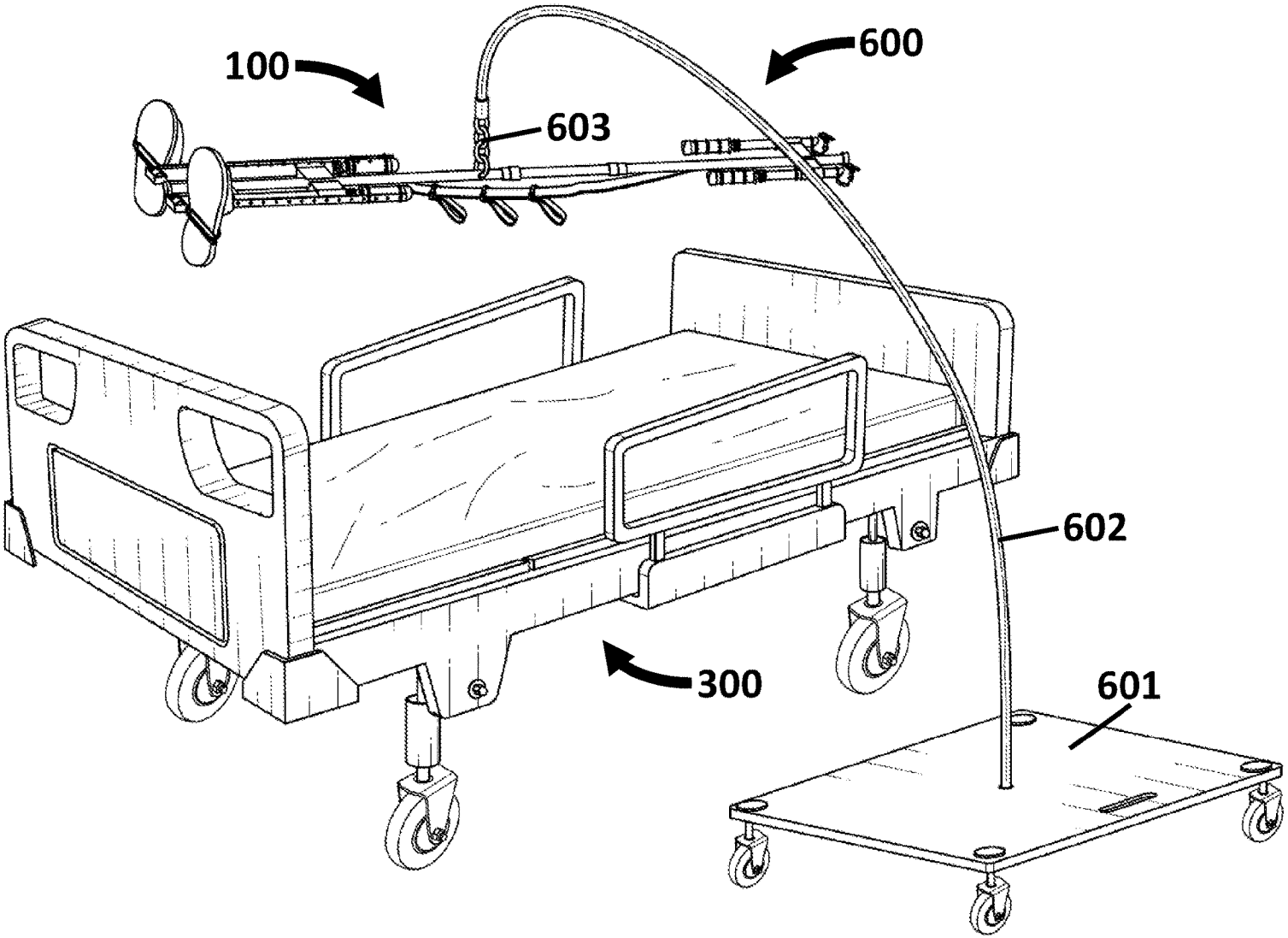
FIG. 9 is a perspective view of the exercise system suspended over the hospital bed using a tube connected to a roller floor crane.

FIGS. 8-9 show how one of the spine segments 101-103 is capable of coupling to and hanging off an assembly incorporating a single tube connector 500 or a floor crane 600. FIG. 8 shows a plurality of flexible tubes 501, 503, 505, 507 each attached at one end to either the headboard 305 or footboard 304 at points 502, 504, 506, and 508, respectively. The remaining open ends of the flexible tubes 501, 503, 505, 507 are merged at a tube connector 509 with tubular slots capable of receiving the flexible tubes. A hanging element 510 such as a chain or cord is attached to the tube connector 509 and one of the segments of the spine 101-103.

FIG. 9 shows a floor crane 600 with a base 601 that can have wheels attached underneath for mobility. A flexible tube 602 is attached on one end to the base 601 and at the other end with a hanging element such as a chain or cord 603. The remaining end of the hanging element 603 is attached to one of the segments of the spine 101-103.

Figure 10:
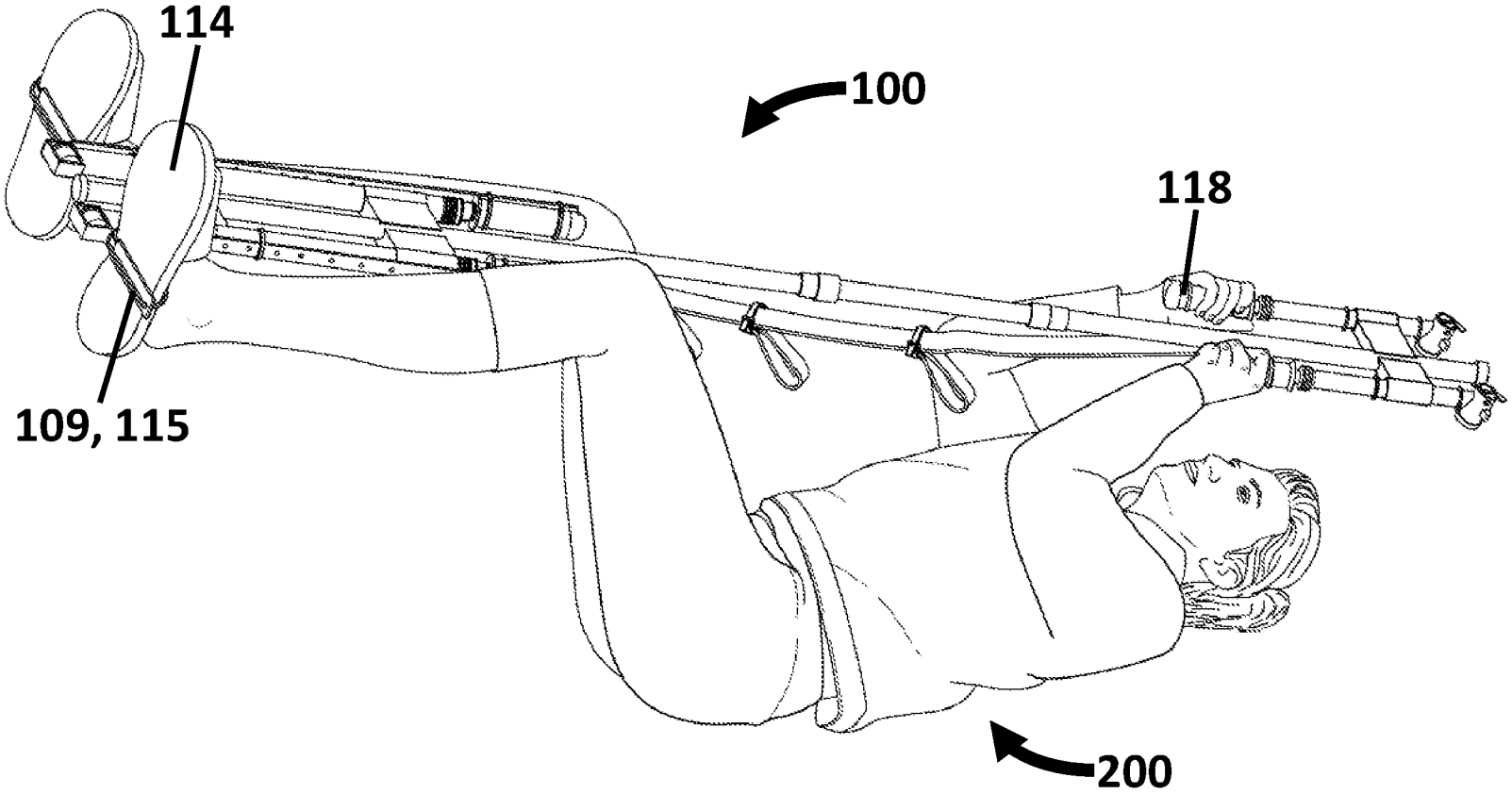
FIG. 10 is a perspective view of an exercise system comprising a plurality of struts and its user, where all the strut rods all in their fully retracted state.
Figure 11:
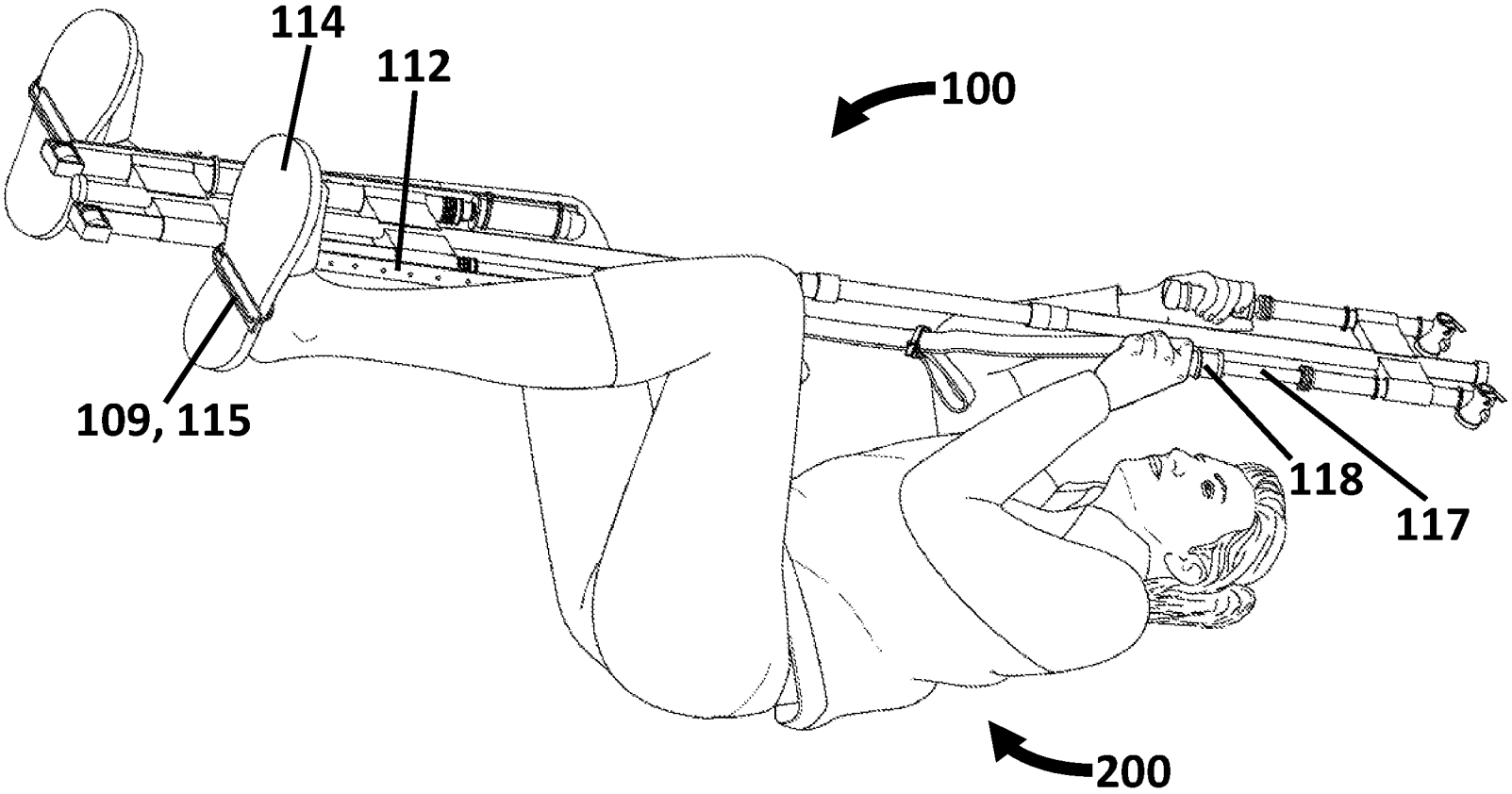
FIG. 11 is a variation of FIG. 10, where the rods for the upper and lower struts on the user's left side are in an extended state.
Figure 12:
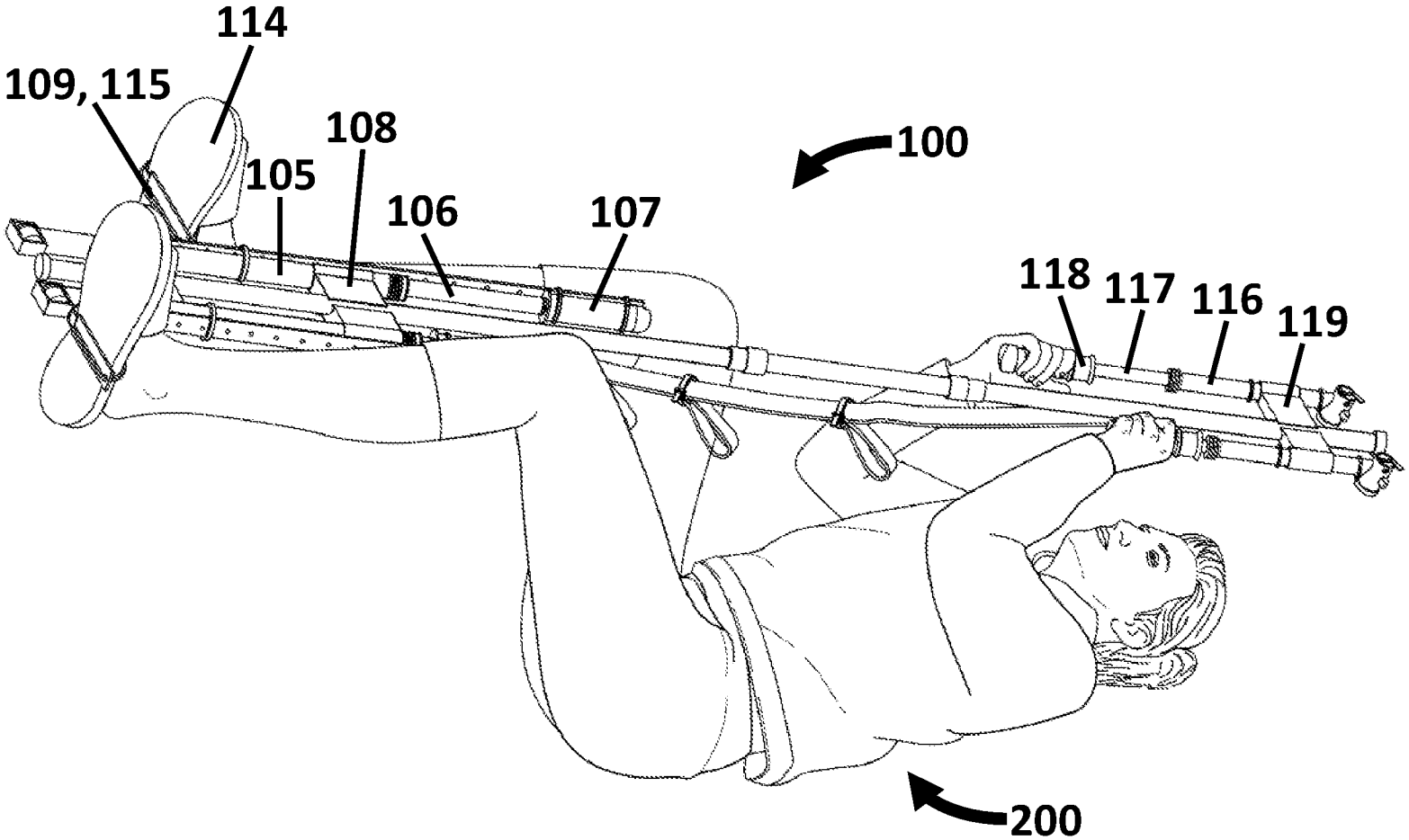
FIG. 12 is a variation of FIG. 10, where the rods for the upper and lower struts on the user's right side are in an extended state.

FIGS. 10-12 depict a user 200 in the supine position with no extended strut rods 106, 117 (FIG. 10), left strut rods extended (FIG. 11), and right strut rods extended (FIG. 12), akin to motions during climbing. The strut rods do not need to be simultaneously extended per side, but such actions balance the directional forces generated by the arms and the legs for stability. During simultaneous extension on a given side, the spine segments 101-103 would principally be subjected to bending stresses.

Figure 13:
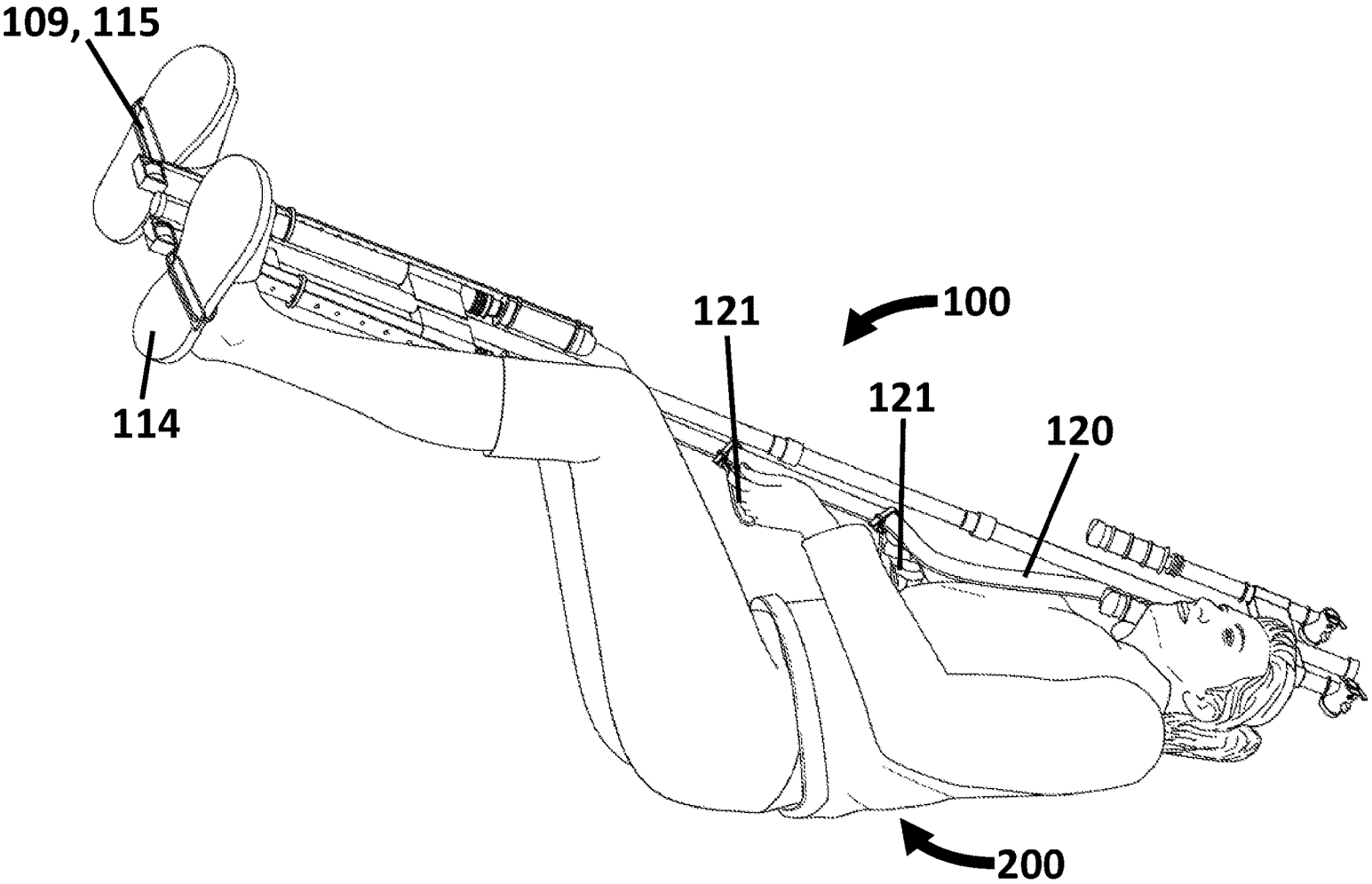
FIG. 13 is a perspective view of the exercise system comprising a center strap and a plurality of hand loops along with its user, where the user has just completed an abdominal crunch cycle or is about to begin another abdominal crunch cycle.
Figure 14:
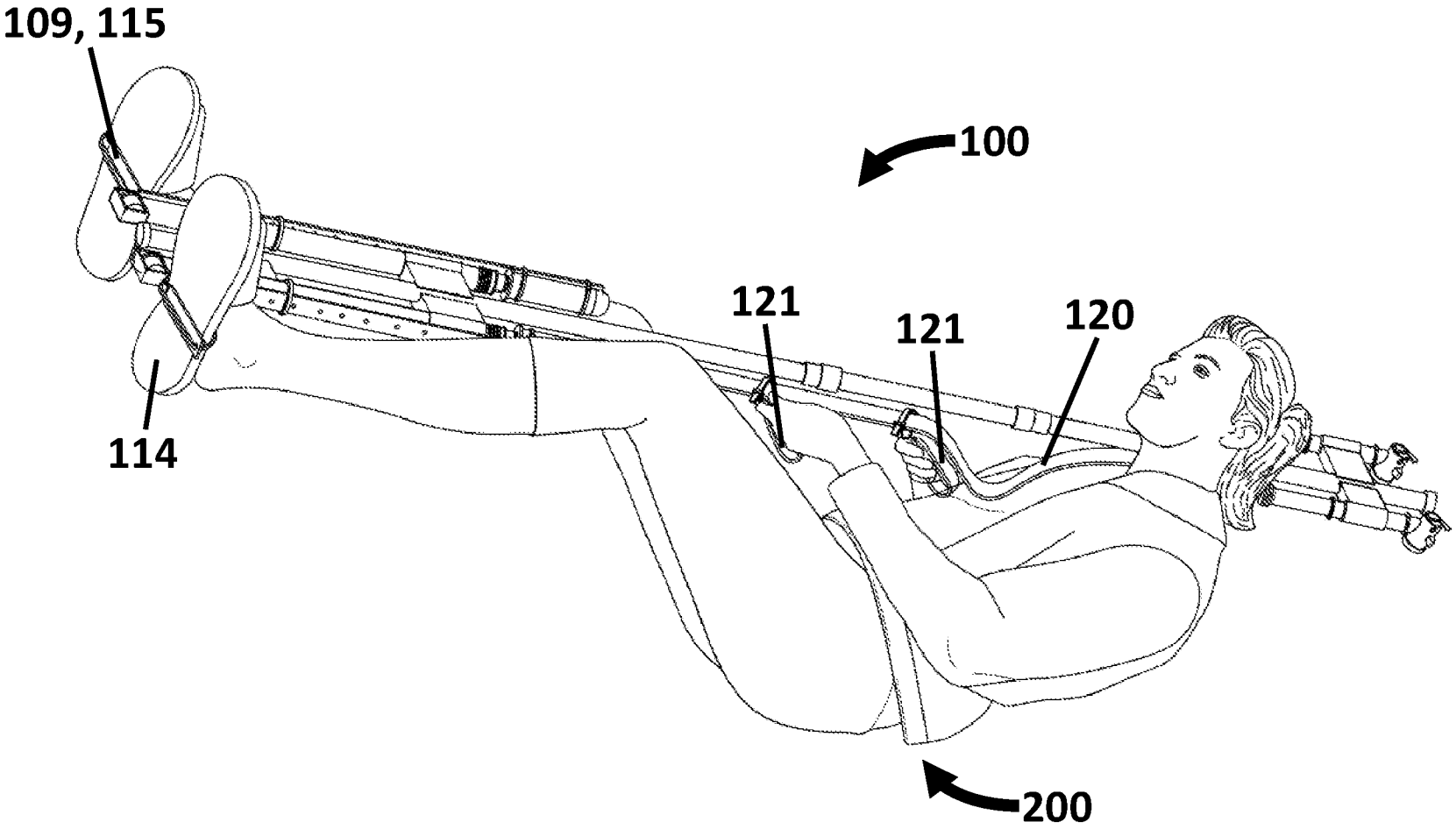
FIG. 14 is a variation of FIG. 13, where the user is nearing completion of an abdominal crunch cycle or is in the early stages of an abdominal crunch cycle.
Figure 15:
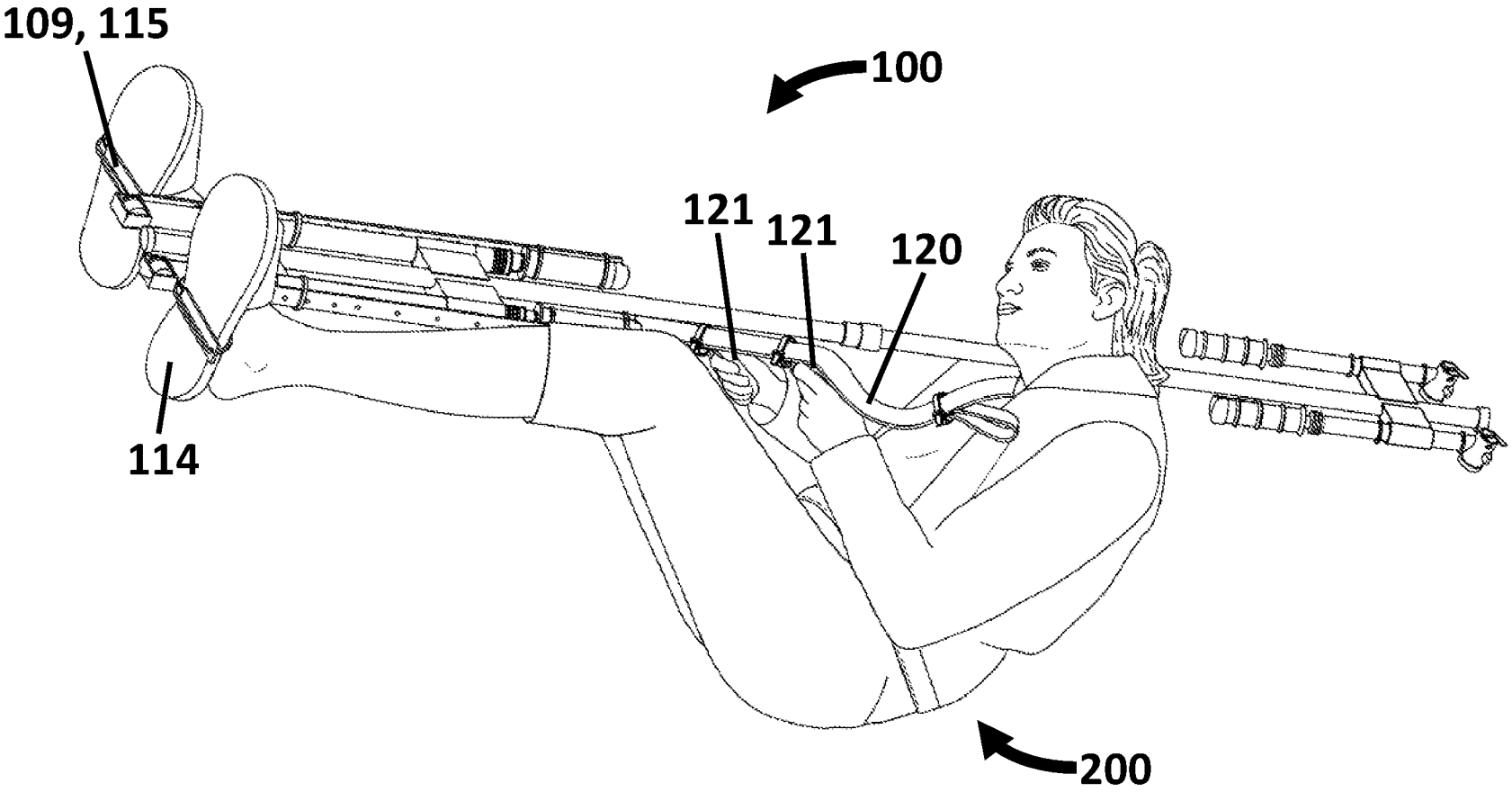
FIG. 15 is a variation of FIG. 13, where the user is around the mid-cycle stage of an abdominal crunch exercise.

FIGS. 13-15 depict the user 200 using the exercise system 100 to aid in doing abdominal crunches. Abdominal crunches are difficult to do for many weak and/or injured individuals so the exercise system's 100 previously mentioned strap 120 and series of hand loops 121 on the strap allow the user 200 to self-assist in sit-up as well as control the transition back to a lie-flat position. FIG. 13 depicts the starting or ending position of an abdominal crunch. FIG. 14 shows a variation of FIG. 13, where the user 200 is nearing completion of an abdominal crunch cycle or is in the early stages of an abdominal crunch cycle. The user would move hand over hand in alternating fashion over successive loops along the strap to maintain the best leverage in assisting with the exercise routine. FIG. 15 is another variation of FIG. 13, where the user is around the mid-cycle stage of an abdominal crunch exercise. Following in sequence from FIG. 13 to FIG. 15, one can surmise how the system 100 is used during the sit-up portion of the abdominal exercise cycle. Conversely, following the reverse sequence from FIG. 15 to FIG. 13 illustrates the lie-down portion of the abdominal exercise cycle.

In conclusion, the disclosure is drawn to a laterally symmetrical system 100 that anatomically resembles four extremities branching out at each corner of a human torso. When the struts 105-106, 116-117 are utilized, climbing-type exercises are performed and condition a wide variety of major muscle groups including but not limited to the gluteus maximus, hip flexors, quadriceps, calves, ankle flexors, triceps, biceps, shoulders while helping to maintain a wide range of motion and to keep many joints loose. Furthermore, on the same device, one can perform abdominal crunches which strengthen the core of the body and promote trunk stability. Finally, the exemplary system 100 weighs around 3 pounds, without using "exotic" materials, and is collapsible and easily transportable.

Many alterations and modifications may be made by those having ordinary skills in the art without departing from the spirit and scope of the embodiment. Therefore, it must be understood that the illustrated embodiment has been set forth only for example and that it should not be taken as limiting the embodiment as defined by the following claims. For example, even though the elements of a claim are set forth below in a certain combination, it must be expressly understood that the embodiment includes other combinations of fewer, more, or different elements, which are disclosed herein even when not initially claimed in such combinations.

DYCEM® is a registered trademark of Dycem Limited.

What is claimed:

1. A system for full-body muscle conditioning comprising:

a spine comprising an upper endpoint and a lower endpoint at opposite ends of said spine;

said spine further comprising a lower extremity segment that includes said lower endpoint and an upper extremity segment that includes said upper endpoint;

a pair of lower extremity struts mounted laterally offset from and parallel to the spine's lower extremity segment;

said lower extremity struts each comprising a lower strut housing and a lower strut rod;

a pair of upper extremity struts mounted laterally offset from and parallel to the spine's upper extremity segment;

said upper extremity struts each comprising an upper strut housing and an upper strut rod.

2. The system of claim 1:

wherein:

each said lower strut rod is capable of being axially extended or undergo an extension and axially retracted or undergo a retraction from and into said lower strut housing, respectively, and therefore capable of having a displacement velocity or lower rod motion when an external force is imparted on said lower strut rod;

said lower rod motion is capable of generating resistive forces or lower rod resistance developed within said lower strut housing;

said lower rod resistance dampens lower rod motion during extension and/or lower rod resistance dampens lower rod motion during retraction;

each said lower strut rod comprises a lower rod distal end that is outside said lower strut housing while the lower strut rod is fully retracted into said lower strut housing.

3. The system of claim 1:

wherein:

each said upper strut rod is capable of being axially extended or undergo an extension and axially retracted or undergo a retraction from and into said upper strut housing, respectively, and therefore capable of having a displacement velocity or upper rod motion when an external force is imparted on said upper strut rod;

said upper rod motion is capable of generating resistive forces or upper rod resistance developed within said upper strut housing;

said upper rod resistance dampens upper rod motion during extension and/or upper rod resistance dampens upper rod motion during retraction;

each said upper strut rod comprises an upper rod distal end that is outside said upper strut housing while the upper strut rod is fully retracted into said upper strut housing.

4. The system of claim 2, said system further comprising:

a pair of force transfer linkages;

wherein:

each of said force transfer linkages is capable of transferring an external force from a user's foot to each lower strut rod;

each of said force transfer linkages comprises a pedal, a pushrod, a pushrod guide, and a lower strut rod coupling provision that couples said pushrod to said lower rod distal end.

5. The system of claim 4, wherein each of said force transfer linkages further comprises a footwear element, wherein each said footwear element is coupled to said pedal.

6. The system of claim 4, wherein each of said force transfer linkages further comprises:

a heel-stop subassembly;

a heel-stop fastener with a shaft that establishes an axis of rotation of said heel-stop subassembly;

wherein:

said heel-stop subassembly comprises an L-shaped bracket;

one distal end of said L-shaped bracket comprises a curved heel retainer;

said heel-stop fastener is disposed through said pedal and the L-shaped bracket at an opposite distal end of said curved heel retainer.

7. The system of claim 6, wherein the heel-stop subassembly is rotatable about the axis of rotation of said heel-stop fastener's shaft.

8. The system of claim 3, said system further comprising a pair of hand grips, wherein each of said hand grips is attached to said upper rod distal end.

9. The system of claim 1, said system further comprising:

a strap having a first endpoint and a second endpoint;

wherein the first endpoint of said strap and the second endpoint of said strap are attached to the spine at two different locations of said spine;

said strap further comprising a plurality of hand loops.

10. The system of claim 1, wherein said spine further comprises a middle segment that is removably placed between said upper extremity segment and said lower extremity segment.

11. The system of claim 1, wherein the lower endpoint is removably coupled with a structure that attaches to a footboard or a structure at one end of a bed frame.

12. The system of claim 1, wherein the spine is removably attached and hanging off a single tube connector or a floor crane.

13. The system of claim 12, said system further comprising:

a plurality of flexible tubes;

wherein:

each of said tubes comprises of a first endpoint and a second endpoint;

the first endpoint of each of said tubes is connected to said tube connector;

the second endpoint of each of said tubes is connected to a bed frame.

14. A system for full-body muscle conditioning comprising:

a spine comprising an upper endpoint and a lower endpoint at opposite ends of said spine;

said spine further comprising a lower extremity segment that includes said lower endpoint and an upper extremity segment that includes said upper endpoint;

a pair of lower extremity resistance elements mounted laterally offset from and parallel to the spine's lower extremity segment; and a pair of upper extremity resistance elements mounted laterally offset from and parallel to the spine's upper extremity segment;

wherein:

each of said pair of lower extremity resistance elements is coupled to a force transfer linkage that includes a foot pedal;

each said foot pedal is independently axially translatable along a direction that extends or retracts each of said pair of lower extremity resistance elements.

15. The system of claim 14, further comprising:

a heel-stop subassembly attached to each said foot pedal;

a heel-stop fastener with a shaft that establishes an axis of rotation of said heel-stop subassembly;

wherein:

said heel-stop subassembly comprises an L-shaped bracket;

one distal end of said L-shaped bracket comprises a curved heel retainer;

said heel-stop fastener is disposed through said pedal and the L-shaped bracket at an opposite distal end of said curved heel retainer.

16. The system of claim 14, said system further comprising:

a strap having a first endpoint and a second endpoint;

wherein the first endpoint of said strap and the second endpoint of said strap are attached to the spine at two different locations of said spine;

said strap further comprising a plurality of hand loops.

17. The system of claim 14, wherein said spine further comprises a middle segment that is removably placed between said upper extremity segment and said lower extremity segment.

18. The system of claim 14, wherein the lower endpoint is removably coupled with a structure that attaches to a footboard or a structure at one end of a bed frame.

19. The system of claim 14, wherein the spine is removably attached and hanging off a single tube connector or a floor crane.

20. The system of claim 19, said system further comprising:

a plurality of flexible tubes;

wherein:

each of said tubes comprises of a first endpoint and a second endpoint;

the first endpoint of each of said tubes is connected to said tube connector;

the second endpoint of each of said tubes is connected to a bed frame.

* * * * *